United States Patent [19]

Olson

[11] Patent Number: 4,600,119

[45] Date of Patent: Jul. 15, 1986

[54] HELICAL COIL DISPENSING MACHINE APPARATUS

[76] Inventor: Wayne L. Olson, Keystone Rte., Box 7006, Rapid City, S. Dak. 57701

[21] Appl. No.: 632,307

[22] Filed: Jul. 19, 1984

[51] Int. Cl.[4] ..... G07F 11/36

[52] U.S. Cl. ..... 221/75; 221/154; 221/197

[58] Field of Search ..... 221/1, 75, 154, 281, 221/197, 198, 311, 312 A, 312 R, 312 B, 123, 124, 277; 211/59.2, 59.3, 126; 312/35

[56] References Cited

U.S. PATENT DOCUMENTS

| | | | |
|---|---|---|---|
| 2,623,641 | 12/1952 | Shield | 211/59.2 |
| 3,883,039 | 5/1975 | Wittern et al. | 221/75 |
| 3,929,255 | 12/1975 | Wittern et al. | 221/75 |
| 3,990,754 | 11/1976 | Pitel et al. | 312/35 |
| 4,061,245 | 12/1977 | Lotspeich | 221/75 |
| 4,252,002 | 2/1981 | Mullins, Jr. | 285/402 X |

*Primary Examiner*—Joseph J. Rolla
*Assistant Examiner*—Kevin P. Shaver
*Attorney, Agent, or Firm*—Fulwider, Patton, Rieber, Lee & Utecht

[57] ABSTRACT

Apparatus for dispensing small items. A removable dispensing tray has a spiral ejector, each coil of which is loaded with one item. The dispensing tray is placed in position on its dispensing station, which station has a drive motor to rotate the spiral ejector. Upon an activating signal, the motor rotates the ejector one time, causing one item to be dispensed. The dispensing tray includes a tray latching bar which latches to a station latching bar to hold the dispensing tray.

14 Claims, 6 Drawing Figures

HELICAL COIL DISPENSING MACHINE APPARATUS

BACKGROUND OF THE INVENTION

1. Field of the Invention

This invention is in the general field of vending machines, and more particularly in the field of machines for dispensing one of a large number of different kinds of small items such as individual pills containing medicine.

2. The Prior Art

There are many kinds of dispensing machines which can dispense items on demand. Some of such machines are configured as coin-operated vending machines intended for use in selling items to the public. Other dispensing machines are used to automatically select and dispense one of a number of different kinds of items, such as medicine, access to which must be controlled. Such machines typically contain only one, or at most a few, different kinds of items for dispensing. An example of such a dispensing machine is the wellknown candy machine, which typically dispenses from one to about a dozen different kinds of candy bars. Such machines are generally refilled by loading the items to be dispensed into hoppers or the like; there will be a separate hopper for each different kind of item to be dispensed, and a large quantity of a given kind of item will be loaded into the appropriate hopper so that many items of that kind can be dispensed before it is again necessary to refill the machine.

As the number of different kinds of items to be dispensed becomes larger, and especially as the physical size of the items becomes smaller, refilling the dispensing machine becomes more difficult. This problem is particularly acute in the case of machines which must dispense any one of a large variety of very small items, such as pills, capsules, or the like, one at a time. In addition, mechanisms which can dispense small items are mechanically very intricate and, as a result, subject to frequent failure. Accordingly, there is a need for a mechanically simple, reliable apparatus which can dispense very small items and which is easy to refill.

SUMMARY OF THE INVENTION

I have invented a new method and apparatus for dispensing small items. My invention is especially well suited for dispensing individual doses of medicine, but it can be used in many different kinds of vending or dispensing machines.

The apparatus which I have invented comprises two assemblies: a dispensing station and a dispensing tray which can be removed from the dispensing station for refilling.

The method which I have invented comprises the steps of prepacking small items into small envelopes or other suitable containers; loading all the containers of one kind of item into a dispensing tray; installing the dispensing tray in its corresponding dispensing station; and, when it is desired to dispense an item, selecting the appropriate dispensing station and activating it so that the item is dispensed. Each container might contain only a single item, or it might contain a plurality of items; for example, each container might contain one dose of medicine, which dose would consist of two or more pills. Optionally, each container is marked with a machine-readable code; reading this code as the container is dispensed automatically verifies that the correct item has been dispensed and makes a permanent record of what has been dispensed.

Each dispensing tray has a horizontally-positioned spiral ejector which rotates 180 or 360 degrees on its axis each time it is activated. The dispensing tray, complete with its spiral ejector, clips into a dispensing station which has a drive motor. The drive motor shaft has a pin which engages the ejector.

When the user of the dispensing machine has selected the item to be dispensed, an electrical activation signal is transmitted to the appropriate dispensing station. The motor rotates the ejector 180 or 360 degrees, and one item is pushed out the open end of the dispensing tray and falls down to an opening from whence it may be removed from the machine. Each dispensing tray easily can be unclipped and removed from its dispensing station for refilling. Also, each such tray has a deflector under its open end, which deflects the dispensed item away from the mechanism as it falls. The deflector can be labeled with the name or other identification of the item dispensed by that particular dispensing tray.

Other objects and advantages of this invention will be apparent to those skilled in the art upon a consideration of the description and drawings herein.

DESCRIPTION OF THE PREFERRED EMBODIMENT

Figure 1:
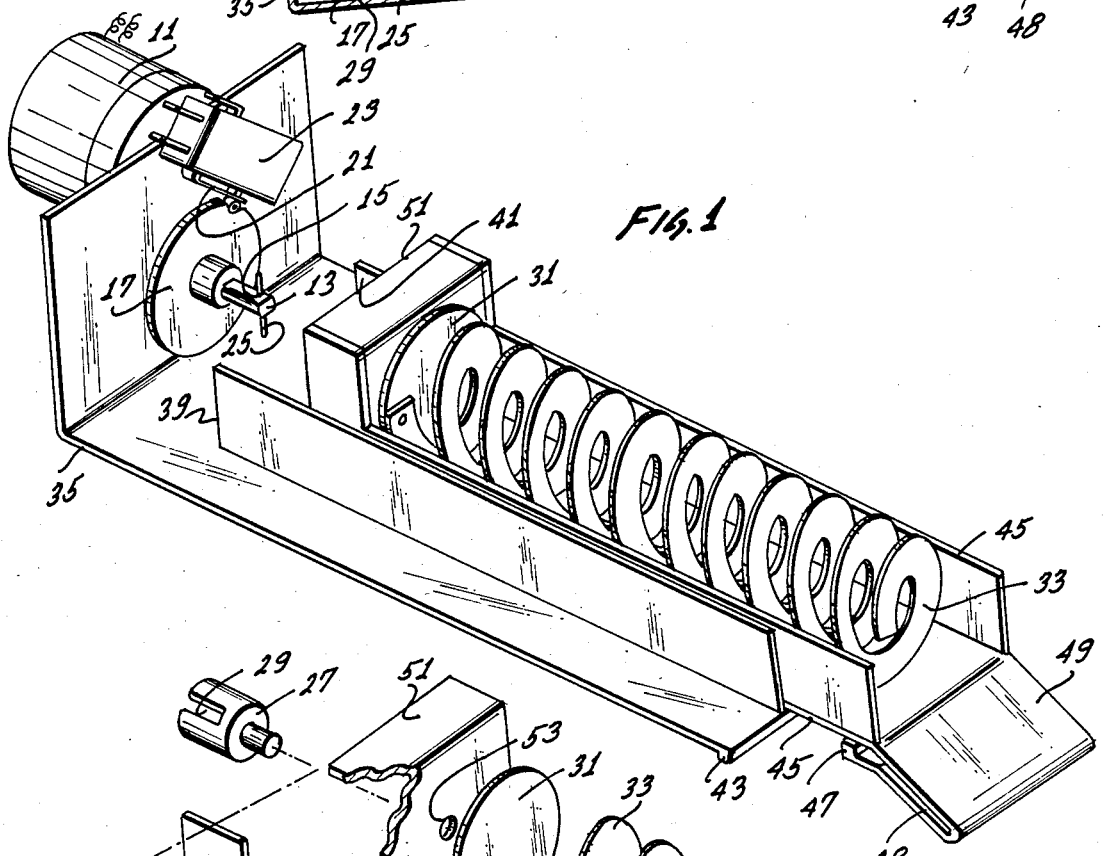
FIG. 1 is a perspective view, with the dispensing tray partially removed from the dispensing station.
Figure 4:
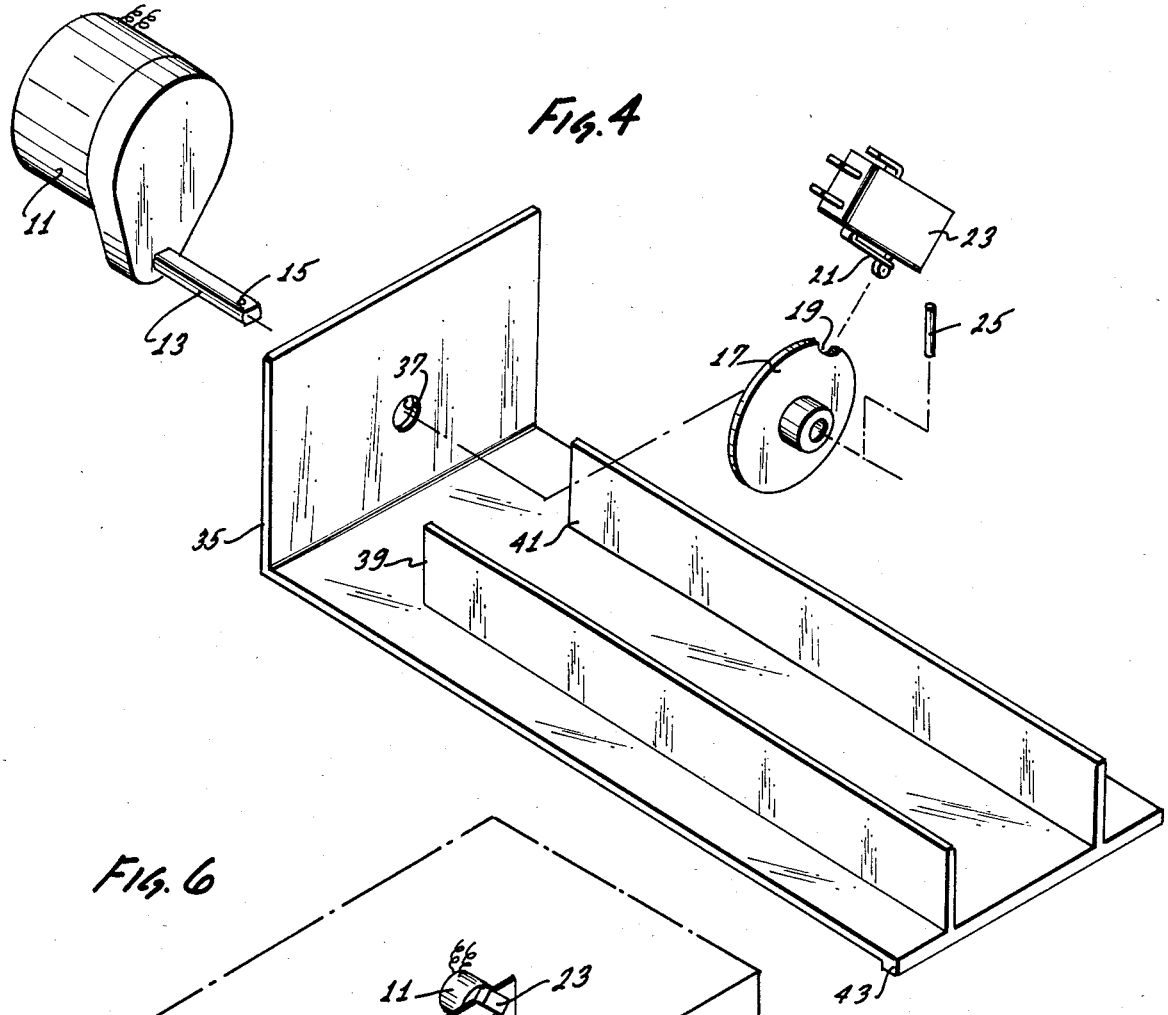
FIG. 4 is an exploded view of the dispensing station.

In FIG. 1, drive motor 11 is mounted on base 35. Cam 17 and drive pin 25 are mounted on motor shaft 13. Cam 17 operates snap action switch 23. These components, which together form the dispensing station, are shown in exploded view in FIG. 4. In addition, FIG. 4 shows hole 15 in motor shaft 13, into which hole drive pin 25 is installed. Motor shaft 13 passes through hole 37. Snap action switch 23 has actuator 21, which actuator is operated by notch 19 in cam 17. Side rails 39 and 41 form a channel into which the dispensing tray slides. Station latching bar 43 holds the dispensing tray firmly in place.

Figure 2:
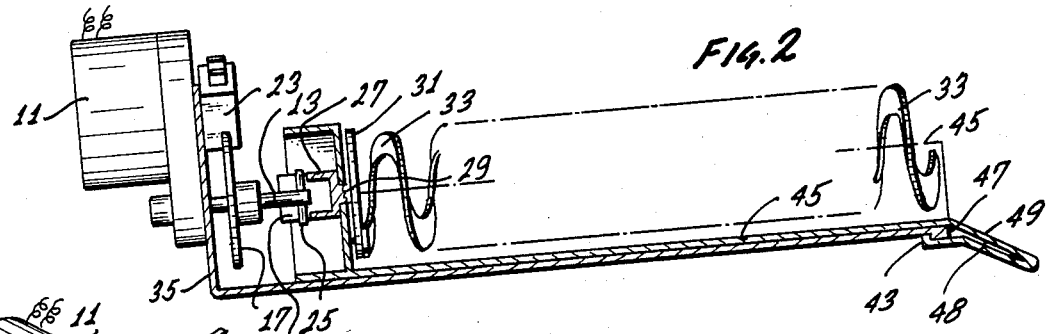
FIG. 2 is a side view, showing the dispensing tray installed in the dispensing station.

Referring again to FIG. 1, dispensing tray 45 has spiral ejector 33 attached to disk 31. Dispensing tray 45 also has label holder 49 which is formed by doubling over the extended bottom member of tray 45, leaving space 48 which is just thick enough to accommodate a label. Label holder 49 is made of transparent material such that the markings on the label can easily be observed. Tray latching bar 47 locked with station latching bar 43 when dispensing tray 45 is inserted all the way into the channel formed by side rails 39 and 41 on base 35. The dispensing tray and the dispensing station are shown locked together in FIG. 2.

Figure 3:
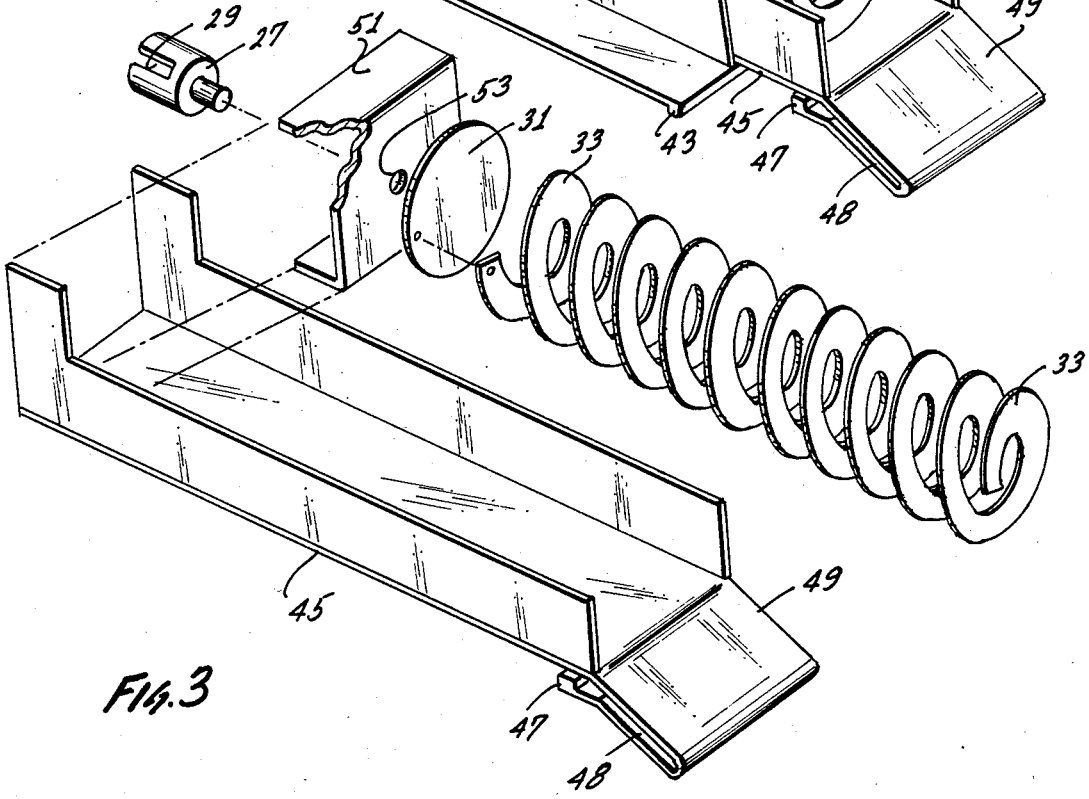
FIG. 3 is an exploded view of the dispensing tray.

In FIG. 3, the parts associated with dispensing tray 45 are shown in exploded view. Drive coupling 27 is rigidly attached to disk 31 throug hole 53 in end piece 51. Drive pin 25 engages slit 29 in drive coupling 27 when dispensing tray 45 is fully inserted into the channel formed by side rails 39 and 41.

Figure 5:
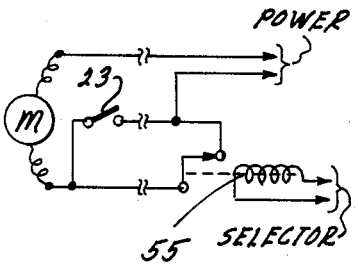
FIG. 5 is a wiring diagram of the switch and motor.

FIG. 5 illustrates the wiring of motor 11, snap action switch 23, the external power source, and selector 55. Selector 55 is illustrated as a relay, but it could be a switching transistor or some other method of momentarily applying power to motor 11.

Figure 6:
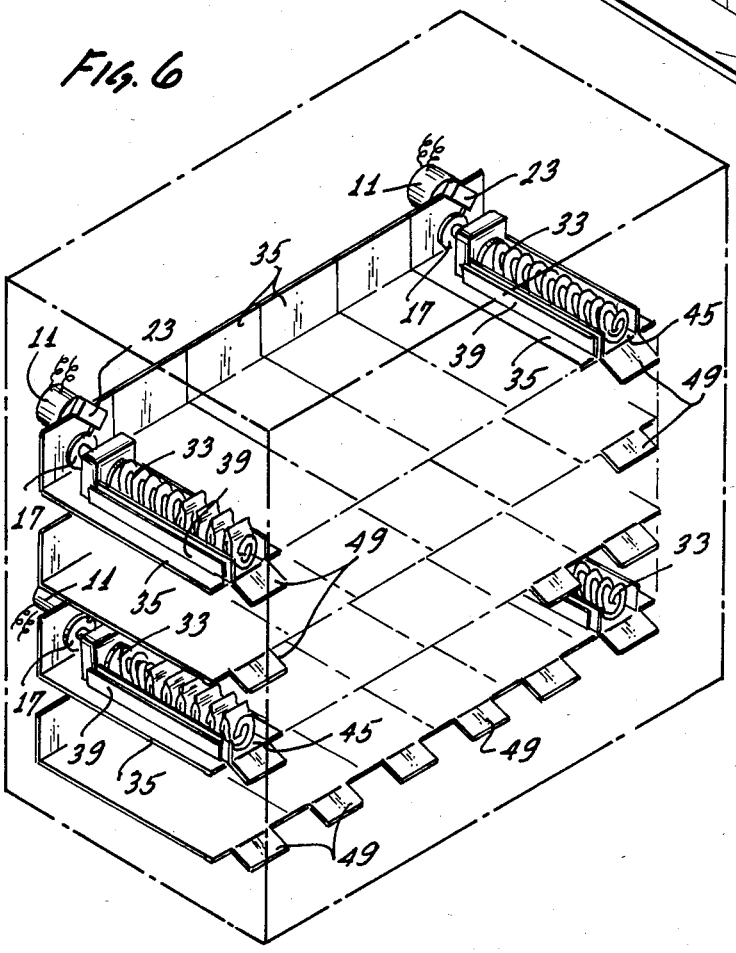
FIG. 6 shows a plurality of dispensing devices installed in a dispensing machine cabinet.

FIG. 6 illustrates a set of dispensing devices in one possible arrangement within a dispensing cabinet.

In operation, dispensing tray 45 is removed from base 35 by finger pressure pulling tray latching bar 47 downward until it disengages from station latching bar 43. Then one item to be dispensed (a single item, a small container, or the like) is loaded into each space between adjacent coils of spiral ejector 33 and, when ejector 33 is fully loaded, tray 45 is put back into the channel of base 35 until latching bars 47 and 43 latch together. Drive pin 25 engages drive coupling 27 so that when the motor is activated it will turn ejector 33. A momentary activation signal from selector 55 starts the motor turning. The motion of cam 17 closes switch 23, causing motor 11 to continue to turn for one complete revolution. As the spiral ejector turns, one item is released and, as the item falls, it is guided by the sloping surface of label holder 49. At the end of one revolution, snap action switch 23 opens, stopping the motor. When another activation signal arrives, the process is repeated.

Although I have described and illustrated one specific embodiment of this invention, it is to be understood that my invention is not to be limited to the specific forms or arrangements of parts as described and illustrated, and that various changes can be made within the scope of this invention.

Having thusly described the invention,

I claim:

1. Dispensing apparatus for dispensing articles, comprising:

a dispensing station which has a channel for holding a dispensing tray;

an elongated dispensing tray having an open end and a bottom for supporting the articles to be dispensed, the tray also having a tray latching bar that has an upper surface and is disposed beneath the tray adjacent the bottom thereof and extending transversely thereto, the upper surface of the latching bar being spaced from the bottom of the tray;

a station latching bar on the underside of said dispensing station, which station latching bar is so positioned that when the dispensing tray is placed into position in said channel on said dispensing station, said station latching bar will latch with the tray latching bar extending beneath the bottom of surface of said tray, thereby holding the dispensing tray tightly in position in the dispensing station;

a spiral ejector positioned horizontally within the dispensing tray, one end of which ejector extends to the open end of said tray;

an end piece disposed in the dispensing tray and having a hole therethrough;

means to rotate the ejector on its axis through a predetermined angular displacement each time an activating compound is received; and coupling means, extending through the hole in the end piece, for coupling the ejector to the rotating means.

2. Apparatus according to claim 1, comprising in addition, a downward sloping extension of the bottom of said dispensing tray extending beyond the open end thereof.

3. Apparatus according to claim 1 wherein the dispensing tray includes means extending beyond the open end thereof defining a space for receiving a label to identify the articles to be dispensed.

4. Apparatus according to claim 1, wherein the means to rotate said ejector comprises an electric motor.

5. Apparatus according to claim 4, wherein the coupling means is disposed between said motor and said ejector, said coupling means comprises a cylindrical coupling, one end of which has a notch and the other end of which has a shaft, and a second shaft with a pin mounted in and perpendicularly to said second shaft, which pin is slightly longer than the diameter of the cylindrical coupling and which pin has a diameter slightly less than the width of said notch, one of which shafts is attached to said ejector and the other of which shafts is attached to said motor.

6. Apparatus for dispensing articles, comprising:

an elongated dispensing tray having an open extremity and a bottom;

a tray latching bar having an upper surface disposed beneath the tray adjacent the open extremity thereof, extending transversely thereof, and spaced from the bottom of the tray;

a dispensing station having sides that define an elongated channel for receiving the dispensing tray;

a station latching bar disposed beneath the dispensing station and engageable with the tray latching bar upon location of the dispensing tray in the channel to fix the dispensing tray relative to the dispensing station;

an elongated spiral ejector disposed in the dispensing tray and having adjacent coils for receiving the articles to be dispensed;

rotation means to rotate the ejector; and coupling means for coupling the ejector to the rotation means.

7. Apparatus according to claim 6 wherein the rotation means comprises an electric motor.

8. Apparatus according to claim 6 wherein the rotation means is carried by the dispensing station and the coupling means detachably connects the ejector and rotating means whereby the ejector is disconnected from the rotation means when the tray is removed from the station.

9. Apparatus according to claim 6 and further comprising limit means for limiting the rotation of the ejector to dispense a predetermined number of the articles.

10. Apparatus according to claim 6 wherein the dispensing tray includes means extending beyond the open extremity thereof defining a space for receiving a label to identify the articles to be dispensed.

11. Apparatus for dispensing articles, comprising:

an elongated dispensing tray having an open extremity and a bottom that has a lower surface, a portion of the bottom extending beyond said extremity and folded back below itself to define a space for receiving a label to identify the articles to be dispensed;

a tray latching bar carried by the folded back portion of the bottom of the dispensing tray and extending transversely thereto, an upper surface of the latching bar being spaced from the lower surface of the tray;

a dispensing station having sides that define an elongated channel for receiving the dispensing tray;

a station latching bar disposed beneath the dispensing station and engageable with the tray latching bar upon location of the dispensing tray in the channel to fix the dispensing tray relative to the dispensing station;

an elongated spiral ejector disposed in the dispensing tray and having adjacent coils adapted for receiving the articles to be dispensed;

rotation means to rotate the ejector; and coupling means for coupling the ejector to the rotating means.

12. Apparatus according to claim 11 wherein the rotation means comprises an electric motor.

13. Apparatus according to claim 11 wherein the rotation means is carried by the dispensing station and the coupling means detachably connects the ejector and rotating means whereby the ejector is disconnected from the rotation means when the tray is removed from the station.

14. Apparatus according to claim 11 and further comprising limit means for limiting the rotation of the ejector to dispense a predetermined number of the articles.

* * * * *

UNITED STATES PATENT AND TRADEMARK OFFICE

CERTIFICATE OF CORRECTION

PATENT NO. : 4,600,119

DATED : July 15, 1986

INVENTOR(S) : Wayne L. Olson

It is certified that error appears in the above-identified patent and that said Letters Patent is hereby corrected as shown below:

Column 1, line 22, delete "wellknown" and insert "well-known".

Column 2, line 60, delete "locked" and insert "locks"; and

Column 3, line 63, delete "compound" and insert "command".

Signed and Sealed this

Seventh Day of October, 1986

[SEAL]

*Attest:*

DONALD J. QUIGG

*Attesting Officer*

*Commissioner of Patents and Trademarks*